United States Patent [19]

Gammache

[11] Patent Number: 4,827,385

[45] Date of Patent: May 2, 1989

[54] POCKET FLASHLIGHT

[76] Inventor: Richard J. Gammache, 82 Pitney Rd., P.O. Box 10007, Lancaster, Pa. 17605-0007

[21] Appl. No.: 186,796

[22] Filed: Apr. 27, 1988

[51] Int. Cl.[4] ..... F21L 7/00

[52] U.S. Cl. ..... 362/206; 362/202

[58] Field of Search ..... 362/157, 202, 205, 206

[56] References Cited

U.S. PATENT DOCUMENTS

| | | | |
|---|---|---|---|
| 1,265,820 | 5/1918 | Seymour | 362/206 |
| 1,408,526 | 3/1922 | Lyhne | 362/206 |
| 1,919,024 | 7/1933 | Abbotts | 362/206 |
| 2,225,936 | 12/1940 | Williams | 362/206 |
| 2,443,539 | 6/1948 | Kopp | 362/206 X |
| 2,818,499 | 12/1957 | Moore | 362/206 X |
| 3,742,207 | 6/1973 | Strauss | 362/206 |
| 4,399,495 | 8/1983 | Leopoldi et al. | 362/189 |
| 4,484,253 | 11/1984 | Roberts | 362/206 |
| 4,516,194 | 5/1985 | Johns | 362/202 |
| 4,563,728 | 1/1986 | Bruggeman et al. | 362/206 |

*Primary Examiner*—Stephen F. Husar

*Attorney, Agent, or Firm*—D. F. Marquette

[57] ABSTRACT

A pocket flashlight utilizes a push button type of switch assembly retained in one end of a cylindrical casing by a metal retainer. A lamp bulb is disposed in the other end of the casing. The switch assembly includes a shuttle formed of conductive material which is movable within a sleeve into and out of electrical contact with the retainer to illuminate and extinguish the bulb. The switch assembly also includes a rotor and a plunger movably disposed in the sleeve. The shuttle may be locked in electrical contact with the retainer by engaging teeth on the rotor with splines on the sleeve.

16 Claims, 4 Drawing Sheets

POCKET FLASHLIGHT

BACKGROUND OF THE INVENTION

This invention relates generally to flashlights and, in particular, to a pocket flashlight of the push button type.

Pocket flashlights such as disclosed in U.S. Pat. No. 4,484,253 to I. J. Roberts have utilized conventional push button mechanisms previously used in ball point pens. In the Roberts flashlight, a push button mechanism and a bulb are located at opposite ends of a cylindrical casing which contains a pair of batteries. The push button mechanism is operated to move a long slender wire (about the same diameter as paper clip wire) inside the casing so that the wire slides into and out of electrical contact with a collar disposed around the bulb. The electrical contact between the wire and the bulb collar forms a "switch" for illuminating the bulb.

A drawback of the Roberts flashlight is that this "switch" is located at one end of the casing but is operated by the push button mechanism located at the other end of the casing. Furthermore, the electrical contact between the wire and the bulb collar is not a positive connection and is influenced by the length of the bulb, the assembly of the bulb and the collar, the shape and location of the bend in the end of the wire adjacent the bulb collar, and the lack of positive pressure urging the wire into electrical contact with the bulb collar.

The Roberts flashlight has another drawback in that replacement of the bulb and the batteries is often a difficult and tedious procedure. This is because the long slender wire must be carefully removed from and then reinserted in the casing without pinching, twisting, kinking, bending or otherwise distorting its shape. A further drawback of the Roberts flashlight is that the casing must have an inside diameter large enough to accommodate the batteries and the wire, thereby resulting in the casing having a larger than desireable outside diameter.

SUMMARY OF THE INVENTION

It is an object of the present invention to provide a pocket flashlight that utilizes a push button type of switch assembly.

Another object of the present invention is to provide a pocket flashlight having a switch assembly and a bulb located at opposite ends of a casing.

It is a further object of the present invention to provide a pocket flashlight having batteries and a standard commercially available bulb which may be easily and quickly replaced.

A further object of the present invention is to provide a pocket flashlight having a casing with a relatively small outside diameter and a length of a typical ball point pen.

The present invention accomplishes these objects by providing a flashlight comprising a casing for containing at least one battery, a bulb retained in one end of the casing, and a switch assembly mounted in the other end of the casing and retained therein by retainer means. The switch assembly includes a shuttle movable into and out of electrical contact with the retainer means for illuminating and extinguishing the bulb.

The flashlight further comprises a sleeve secured to the retainer means and disposed in the casing. The shuttle is movably disposed within the sleeve. The switch assembly also includes a rotor and a plunger movably disposed within the sleeve. The rotor has teeth for engaging splines on the sleeve, and the plunger has keys slidable in slots or keyways in the sleeve. The shuttle is locked in electrical contact with the retainer means when the teeth on the rotor are engaged with the splines on the sleeve.

The switch assembly comprises a first spring normally urging the rotor and the plunger away from the shuttle, and a second spring normally urging the shuttle away from the retainer means. The first spring extends between the rotor and the shuttle; and the second spring extends between the shuttle and a negative terminal of the battery. A push button is mounted in the casing for moving the shuttle toward the retainer means. A third spring normally urges the push button away from a flange portion of the retainer means.

The shuttle has a cylindrical portion receiving an end of the second spring and a flange portion for contacting the retainer means. An insulating spring-like bushing is located between the retainer means and the negative terminal of the battery. The bulb has a first terminal in contact with a positive terminal of the battery. An end cap has a coupler threaded to an insert mounted in the casing. The coupler has an annular shoulder against which a second terminal of the bulb rests. A reflector and a lens are mounted in the end cap.

DESCRIPTION OF THE PREFERRED EMBODIMENT

Figure 1:
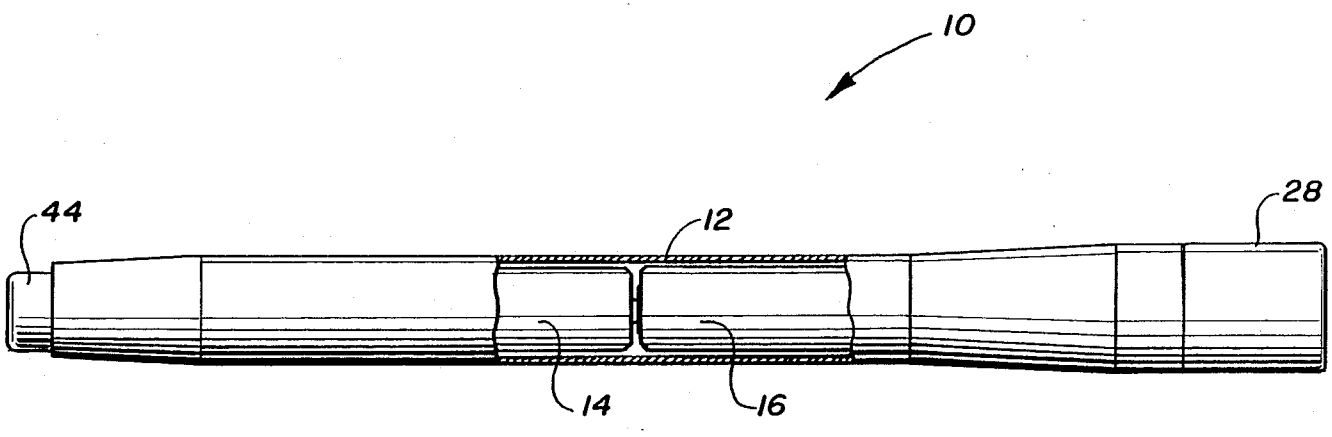
FIG. 1 is a side elevation view, partly in section, of a pocket flashlight according to one embodiment of the present invention.
Figure 2:
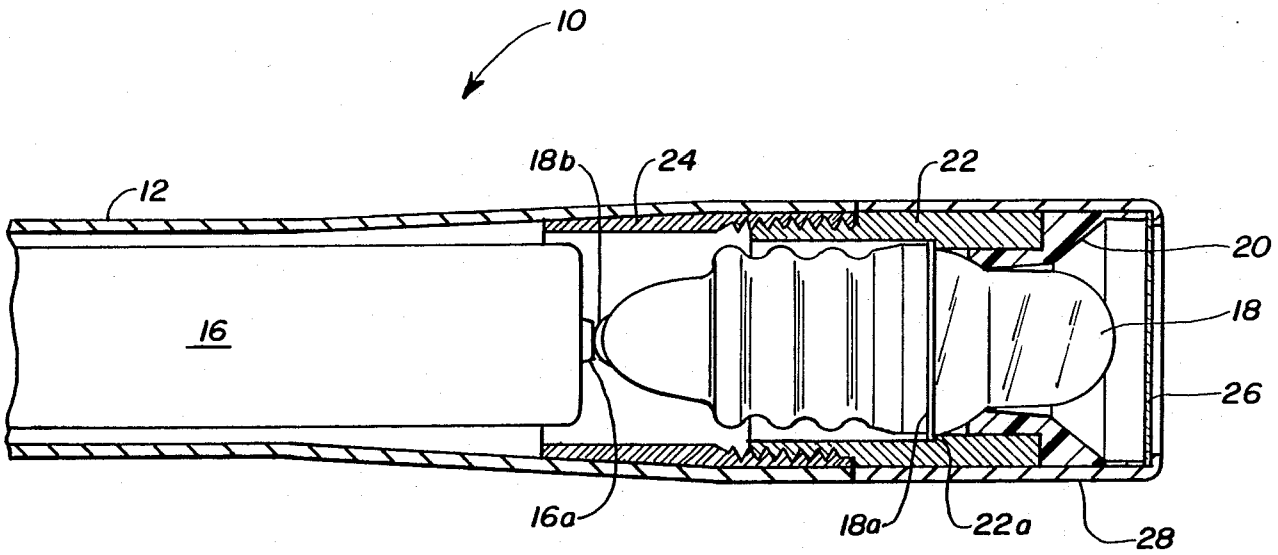
FIG. 2 is an enlarged cross sectional view of a portion of the pocket flashlight shown in FIG. 1.

Referring to FIGS. 1 and 2, a pocket flashlight 10 includes a cylindrical metal casing 12 approximately the size (length and diameter) of a fountain pen. The casing 12 contains a pair of batteries 14, 16 arranged in series and a lamp bulb 18 of the high intensity krypton type. The bulb 18 is retained in one end of the casing 12 by a reflector 20 formed of synthetic material and a metal coupler 22 which is threaded to a metal casing insert 24. The reflector 20, the coupler 22 and a lens 26 are permanently pressed into an end cap 28. The coupler 22 includes an annular shoulder **22*a* against which an annular metallic flange 18*a* of the bulb 18 rests to properly align the bulb filament with respect to the reflector 20 and to provide electrical contact between the bulb 18 and the coupler 22. The bulb flange 18*a* forms a first terminal of the bulb 18. A second terminal 18*b* of the bulb 18 contacts a positive terminal 16*a* of the battery 16**.

Figure 3:
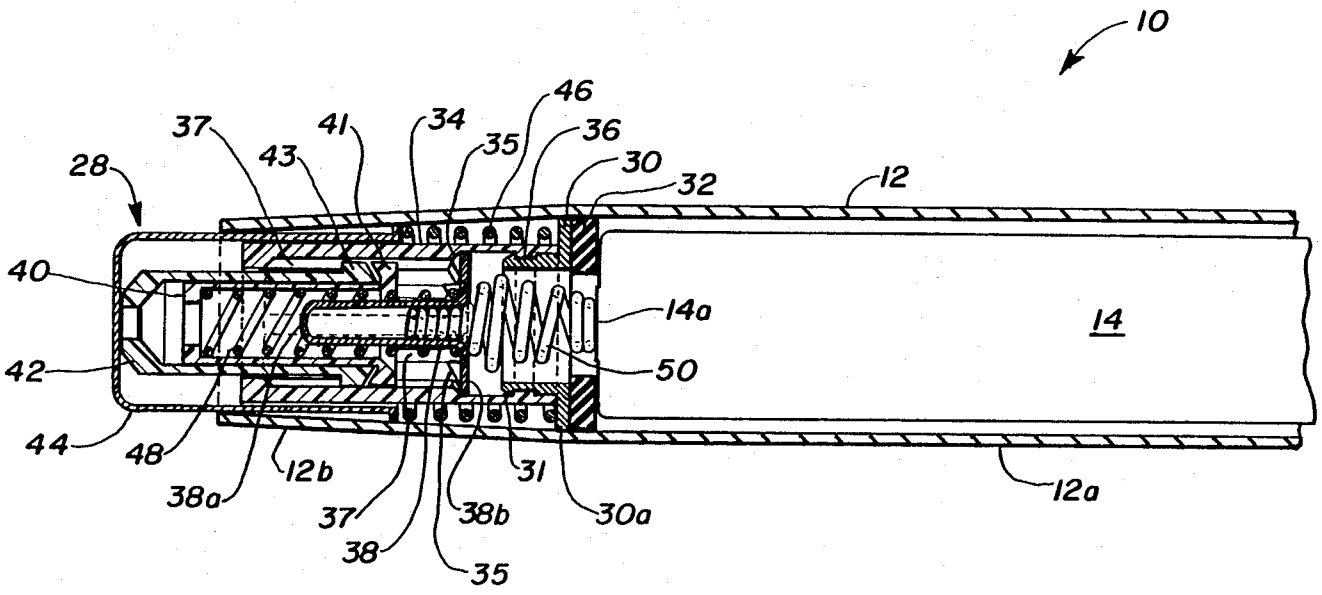
FIG. 3 is an enlarged cross sectional view of another portion of the pocket flashlight shown in FIG. 1.

A switch assembly 28 is mounted in the opposite end of the casing 12 from the bulb 18 as shown in FIG. 3. The switch assembly 28 is preferably of the rotating-ratcheting type used extensively in retractable ball point pens. A metal retainer 30 is disposed in the casing 12 at the intersection between the cylindrical portion **12*a* and the conical portion 12*b* thereof to retain the switch assembly 28 in the casing 12 and to provide electrical contact between the casing 12 and the switch assembly 28. An insulating spring-like bushing 32, preferably formed of rubber, is located between the battery 14 and the retainer 30. A plastic sleeve 34 is attached to the retainer 30 by engaging an annular barb 31 on the retainer 30 with an annular bead 36 formed on the sleeve 34**.

The switch assembly 28 includes a shuttle 38, a rotor 40, a plunger 42 and a push button 44. The shuttle 38 is formed of conductive material such as metal but the rotor 40 and the plunger 42 are formed of nonconductive material such as plastic. The push button 44 may be made from any suitable material. The rotor 40 has a plurality of teeth 41 which are engageable with cam splines 35 formed on the inside of the sleeve 34. The plunger 42 has a plurality of keys 43 which slide in slots or keyways 37 provided in the sleeve 34 intermediate the cam splines 35. The push button 44 is normally urged away from a flange portion **30*a* of the retainer 30 by a spring 46, and the rotor 40 and the plunger 42 are normally urged away from the shuttle 38 by a spring 48 which fits over a cylindrical portion 38*a* of the shuttle 38. Another spring 50 normally urges the shuttle 38 away from the retainer 30 and is compressed between the shuttle 38 and a negative terminal 14*a* of the battery 14. One end of the spring 50 fits within the cylindrical portion 38*a* of the shuttle 38 to keep the spring 50 properly aligned and to prevent it from coming into contact with the retainer 30. The switch assembly 28 is permanently retained in the casing 12 by the retainer 30**.

When the switch assembly 28 is in the "off" mode shown in FIG. 3, the shuttle 38 is pushed away from the retainer 30 by the spring 50 which is partially compressed. This breaks electrical contact between the shuttle 38 and the retainer 30 thereby extinguishing the bulb 18. In this "off" mode of the switch assembly 28, the spring 48 is in its no load or free length state and the push button 44 is pushed away from the retainer 30 by the springs 46 and 48. When the push button 44 is pressed, it moves the plunger 42, the rotor 40 and the spring 48 toward the retainer 30. Spring 48 moves shuttle 38 within the sleeve 34 toward retainer 30 thereby compressing spring 50 until a flange portion **38*b* of the shuttle 38 makes electrical contact with the retainer 30. At this point, the switch assembly 28 is in the "on" mode and the bulb 18 is illuminated. Further pressure on the push button 44 causes the teeth 41 on the rotor 40 to engage the cam splines 35 on the sleeve 34 which locks the shuttle 38 in electrical contact with the retainer 30. With the rotor 40 in this position, the switch assembly 28 is locked in the "on" mode and spring 48 is fully compressed which securely holds the shuttle 38 and the retainer 30 in electrical contact. Releasing pressure on the push button 44 permits the spring 46 to move the push button 44 away from the retainer 30 but the switch assembly 28 remains in the "on" mode and the bulb 18** remains illuminated.

Subsequently pressing the push button 44 moves plunger 42 against rotor 40 which is rotated by the cam splines 35 in the sleeve 34. This releases the rotor 40 from its locked position and permits shuttle 38, spring 48, rotor 40 and plunger 42 to be moved away from the retainer 30 by spring 50 thereby breaking electrical contact between the shuttle 38 and the retainer 30. The switch assembly 28 is thus returned to its "off" mode and the bulb 18 is extinguished.

An important feature of the pocket flashlight 10 is the insulating spring-like bushing 32 formed of nonconductive material and seated between the negative terminal **14*a* of the battery 14 and the retainer 30. The bushing 32 holds the batteries 14, 16 firmly in place while permitting spring 50 to make contact with the battery terminal 14*a*. Any variations in the lengths of the batteries 14, 16 or the bulb 18 are accommodated by the bushing 32 which also serves to push the positive terminal 16*a* of battery 16 against the terminal 18*b* of the bulb 18**.

Removal of the batteries 14, 16 and the bulb 18 may be easily accomplished by rotating the end cap 28 so that the coupler 22 which is permanently mounted in the end cap 28 is unthreaded from the casing insert 24. The end cap 28 is removed and the bulb 18 and batteries 14, 16 may then be removed from the casing 12. The switch assembly 28 is permanently secured in the casing 12 by the retainer 30.

It should be understood that the sleeve 34, the rotor 40 and the plunger 42 are standard parts of a push button mechanism as used in ball point pens. The shuttle 38, however, is a specially designed part of the switch assembly 28. The ratcheting operation of the rotor 40 and the sleeve 34 is the same as commonly performed in the push button mechanisms of ball point pens.

Pocket flashlight 10 is preferably intended to use two AAA size dry cell batteries. The total length of flashlight 10 will be approximately 5½ inches and the outside diameter of the casing 12 will be approximately ½ inch. Flashlight 10 is not, however, limited to this size battery or these dimensions.

Figure 4:
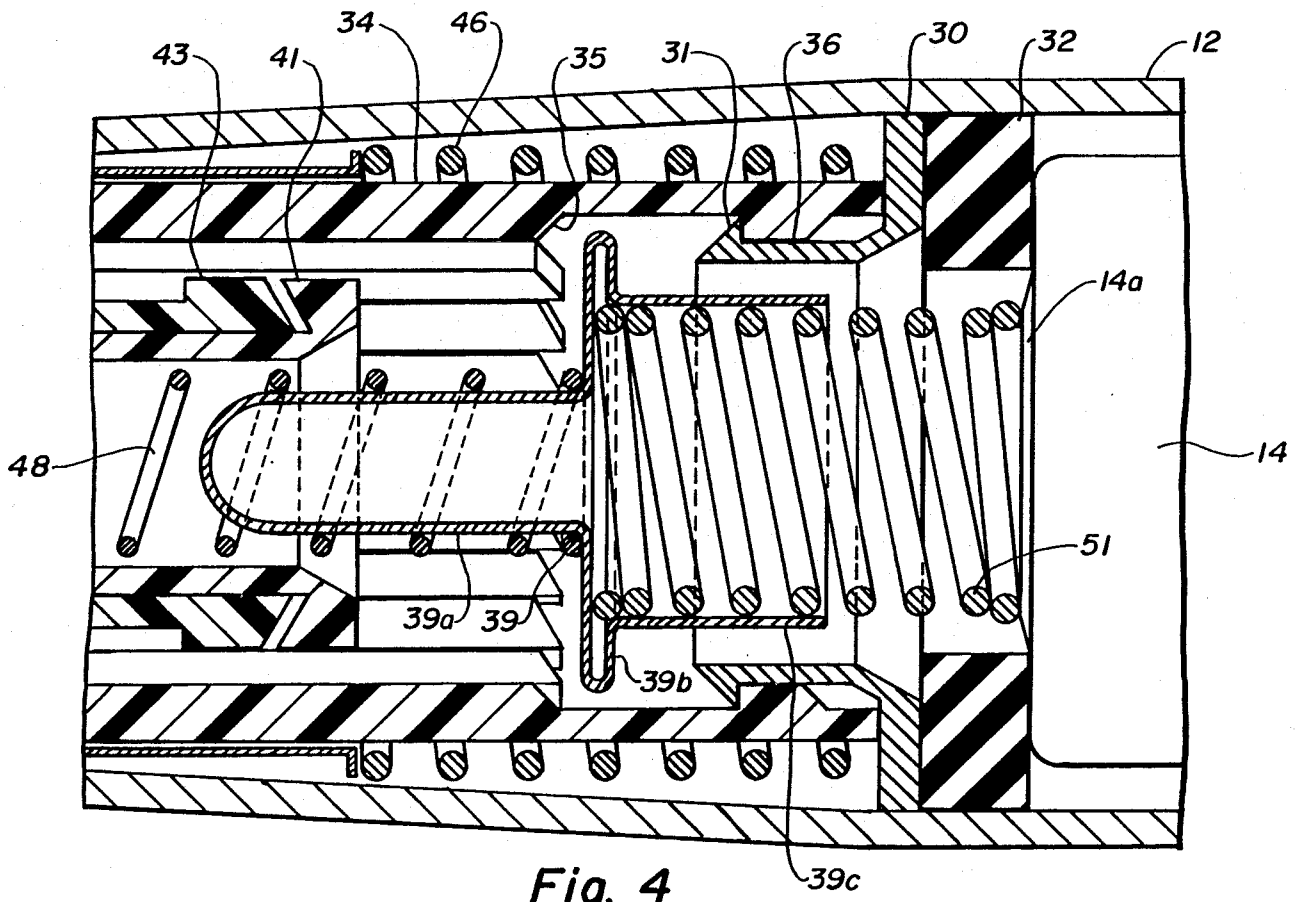
FIG. 4 is a further enlarged cross sectional view similar to FIG. 3 illustrating an alternative embodiment of the pocket flashlight.

In an alternative embodiment of the pocket flashlight 10 illustrated in FIG. 4, shuttle 38 and spring 50 are replaced by a shuttle 39 and a spring 51, respectively. The other parts shown in FIG. 4 such as retainer 30, bushing 32, sleeve 34, rotor 40, plunger 42, and springs 46, 48 are the same as previously described. Shuttle 39 includes a first cylindrical portion **39*a* over which the spring 48 fits, a flange portion 39*b* for contacting the retainer 30, and a second cylindrical portion 39*c* receiving one end of the spring 51. The other end of spring 51 engages the negative terminal 14*a* of battery 14. The retainer second cylindrical portion 39*c* serves to keep the spring 51 properly aligned and to prevent it from coming into contact with the retainer 30**.

It will be understood that the alternative embodiment of the pocket flashlight 10 shown in FIG. 4 operates in the same manner as the embodiment shown in FIG. 3. That is, shuttle 39 is moved into electrical contact with retainer 30 by pressing the push button 44. The shuttle 39 may be locked in electrical contact with the retainer 30 when the teeth 41 on rotor 40 are engaged with the splines 35 on sleeve 34.

What is claimed is:

1. A flashlight comprising:

a casing for containing at least one battery;

a bulb retained in one end of said casing;

a switch assembly mounted in the other end of said casing and retained therein by retainer means; and said switch assembly including a shuttle movable into and out of electrical contact with said retainer means for illuminating and extinguishing said bulb.

2. The flashlight of claim 1, further comprising a sleeve secured to said retainer means and disposed in said other end of said casing, and wherein said shuttle is movably disposed within said sleeve.

3. The flashlight of claim 2, wherein said switch assembly also includes a rotor and a plunger movably disposed within said sleeve, said rotor having teeth for engaging splines on said sleeve, and said plunger having keys slidable in slots or keyways in said sleeve.

4. The flashlight of claim 3, wherein said shuttle is locked in electrical contact with said retainer means when the teeth on said rotor are engaged with the splines on said sleeve.

5. The flashlight of claim 4, wherein said switch assembly comprises a first spring normally urging said rotor and said plunger away from said shuttle, and a second spring normally urging said shuttle away from said retainer means.

6. The flashlight of claim 5, wherein said first spring extends between said rotor and said shuttle.

7. The flashlight of claim 6, wherein said second spring extends between said shuttle and a negative terminal of said battery.

8. The flashlight of claim 5, said switch assembly further comprising a push button mounted in said other end of said casing for moving said shuttle toward said retainer means.

9. The flashlight of claim 8, further comprising a third spring normally urging said push button away from a flange portion of said retainer means.

10. The flashlight of claim 5, wherein said shuttle has a cylindrical portion receiving an end of said second spring and a flange portion for contacting said retainer means.

11. The flashlight of claim 1, further comprising an insulating bushing located between said retainer means and a negative terminal of said battery.

12. The flashlight of claim 1, wherein said bulb has a terminal in contact with a positive terminal of said battery.

13. The flashlight of claim 1, further comprising an end cap having a coupler threaded to an insert mounted in said casing.

14. The flashlight of claim 13, wherein said coupler has an annular shoulder against which a terminal of said bulb rests.

15. The flashlight of claim 14, further comprising a reflector and a lens mounted in said end cap.

16. The flashlight of claim 5, wherein said shuttle has a first cylindrical portion over which said first spring fits, a flange portion for contacting said retainer means, and a second cylindrical portion receiving an end of said second spring.

* * * * *